US007645729B2

(12) United States Patent
Cardozo et al.

(10) Patent No.: US 7,645,729 B2
(45) Date of Patent: Jan. 12, 2010

(54) DETERGENT COMPOSITIONS COMPRISING COLOURED PARTICLES

(75) Inventors: Larry Savio Cardozo, Newcastle-on-Tyne (GB); Eric San Jose Robles, Newcastle-upon-Tyne (GB); Jeffrey Edward Boucher, Beijing (CN); Joanna Margaret Clarke, Beijing (CN)

(73) Assignee: The Procter & Gamble Company, Cincinnati, OH (US)

( * ) Notice: Subject to any disclaimer, the term of this patent is extended or adjusted under 35 U.S.C. 154(b) by 328 days.

(21) Appl. No.: 11/185,479

(22) Filed: Jul. 20, 2005

(65) Prior Publication Data

US 2006/0019860 A1 Jan. 26, 2006

(30) Foreign Application Priority Data

Jul. 22, 2004 (EP) ..... 04254371

(51) Int. Cl.
*C11D 3/14* (2006.01)
*C11D 17/06* (2006.01)
*C11D 11/00* (2006.01)

(52) U.S. Cl. ..... 510/276; 510/349; 510/438; 510/444; 510/451; 510/513; 8/137

(58) Field of Classification Search ..... 510/349, 510/438, 444, 451, 513, 276; 8/137
See application file for complete search history.

(56) References Cited

U.S. PATENT DOCUMENTS

| | | | | |
|---|---|---|---|---|
| 3,529,923 | A | 9/1970 | Perry et al. | |
| 3,931,037 | A | 1/1976 | Hall | |
| 4,082,682 | A | 4/1978 | Inamorato et al. | |
| 4,097,418 | A | 6/1978 | Rolfes | |
| 4,510,066 | A * | 4/1985 | Saar | 510/532 |
| 4,579,677 | A * | 4/1986 | Hooper et al. | 424/76.8 |
| 4,671,886 | A | 6/1987 | Mueller | |
| 5,080,820 | A * | 1/1992 | Grecsek | 510/443 |
| 6,248,706 | B1 * | 6/2001 | Herrmann et al. | 510/320 |
| 6,541,437 | B2 | 4/2003 | Mendez Mata et al. | |
| 2001/0053757 | A1 * | 12/2001 | Mendez Mata et al. | 510/499 |

FOREIGN PATENT DOCUMENTS

| | | |
|---|---|---|
| WO | WO 98/16615 A | 4/1998 |
| WO | WO 00/27980 | 5/2000 |
| WO | WO 00/63341 A | 10/2000 |
| WO | WO 03/018738 | 3/2003 |
| WO | WO 03/057815 A1 * | 7/2003 |

* cited by examiner

*Primary Examiner*—Lorna M Douyon
(74) *Attorney, Agent, or Firm*—David V. Upite

(57) ABSTRACT

The present invention relates to a colored particles and to detergent compositions containing them that can be used to impart a hueing effect to fabrics contacted with these colored particles in aqueous solution. The invention enables the effective hueing while alleviating problems of staining or spotting by combining in the color particle, hueing agent, preferably pigment, binding agent and suspending agent.

14 Claims, No Drawings

DETERGENT COMPOSITIONS COMPRISING COLOURED PARTICLES

FIELD OF THE INVENTION

The present invention relates to coloured particles for use in detergent compositions which are added to impart a hueing effect on fabrics laundered using such detergents.

BACKGROUND OF THE INVENTION

The marketing of detergent products often involves the use of distinctive product aesthetics to help consumer differentiate one given product from another commercially available product of the same general type. Colored e.g. dyed or pigmented, speckles are sometimes used to create distinctiveness. It has been found that some consumers associate products having dyed particles with improved cleaning so that the consumer acceptance of products comprising colored particle can be higher than products not comprising such colored particles. Furthermore, the use of dyes or pigments to provide wash water with a blue colour is also known and has historically been associated with better cleaning of white fabrics. Such "blueing" of the wash water has been achieved by additives containing dyes or pigments for adding directly to the wash water in addition to the laundry detergent. Attempts have been made to incorporate coloured agents into detergent compositions, either to provide particular product aesthetics, blueing of the wash water or even to increase perceived cleaning of white fabrics. However, problems have been associated with the use of dyes or pigments directly in detergents, particularly that they can lead to spotting or staining of the fabrics being laundered.

Examples of art in this area include WO00/27980, which discloses speckle particles having a specific sparkle index and transparency index which is colored by addition of a dye pigment and/or brightener. U.S. Pat. No. 6,541,437 discloses speckled detergent compositions comprising colored glassy phosphates. U.S. Pat. No. 4,097,418 relates to agglomerate colored speckles for use with white or lightly colored detergent granules to provide detergent composition having a distinctive and attractive appearance and which—because of the nature of the agglomerate colored speckles—are non-staining to fabric in use. U.S. Pat. No. 4,671,886 discloses mixing finely divided pigments which form large visible agglomerates with a non-agglomerating granular diluent. This is said to prevent or reduce the formation of visible agglomerates of pigment and prevent staining problems. The premix is used to color granular products such as spray dried granules. However, in all the prior art relating to coloured particles, the issue of fabric staining is so sensitive that particles containing dyes or pigments always do so at low levels to avoid localized high concentrations of colouring materials. For example, U.S. Pat. No. 3,931,037 describes granular detergent product substantially uncolored in its dry state which contains coloring materials. These particles are said not to be subject to separation and segregation and to be readily soluble or dispersible when the detergent is mixed with water to form a colored washing solution.

The present inventors have found that hueing agents such as pigments and/or dyes may be incorporated into detergent particles without causing staining of items to be washed when incorporated in a detergent composition. The particles according to the invention can incorporate relatively high levels of dye and/or pigment and enable use of such particles in detergent compositions at relatively high levels without causing fabric staining or spotting. The present inventors have now found that by incorporating a suspending agent for the hueing agent in the coloured particles, the problems of the prior art are alleviated. Without wishing to be bound by theory the inventors believe that this is because on contact of the detergent composition with water, the coloured particles rapidly dissolve/disintegrate. However, the deposition of the hueing agent is slowed by the suspending agent until concentrated regions of hueing agent are dispersed and this ensures that spotting of the hueing agent, or staining on the fabrics being laundered is substantially avoided.

SUMMARY OF THE INVENTION

The present invention provides a coloured particle for use in a detergent composition, the particle comprising a coloured ingredient which is a hueing agent, and a binder, characterized in that the coloured particle also comprises a suspending agent or suspending agent precursor. The invention also comprises detergent compositions comprising the coloured particles.

DETAILED DESCRIPTION OF THE INVENTION

The Colored Particle

The colored particle typically has a particle size distribution (PSD) between 250 μm and 2500 μm, preferably 500 μm and 2000 μm, and more preferably between 700 μm and 1400 μm. Preferably, the colored particle of the present invention has a Mean Particle Size (MPS) between 700 μm and 1500 μm, and preferably between 800 μm and 1200 μm.

The Particle Size Distribution (PSD) and Mean Particle Size (MPS)

The PSD and MPS of the colored particle of the present invention are measured as follows. The particle size distribution of granular detergent products, intermediates and raw materials are measured by sieving the granules/powders through a succession of sieves with gradually smaller dimensions. The weight of material retained on each sieve is then used to calculate a particle size distribution and median or mean particle size.

Equipment: RoTap Testing Sieve Shaker Model B (as supplied by: W.S. Tyler Company, Cleveland, Ohio), supplied with cast iron sieve stack lid with centrally mounted cork. The RoTap should be bolted directly to a flat solid inflexible base, preferably the floor. The tapping speed used should be 6 taps/minute with a 12 rpm elliptical motion. Samples used should weight 100 g, and total sieving time should be set at 5 mins.

Particle Size Distribution: The fraction on each sieve is calculated from the following equation:

$$\text{Fraction on sieve (\%)} = \frac{\text{Mass on sieve (g)} \times 100}{\text{Original sample weight (g)}}$$

If this calculation is done for each sieve size used then a particle size distribution is obtained. However a cumulative particle size distribution is of more use. The cumulative distribution is calculated by adding the fractions on a particular sieve to the fractions on sieves above it (i.e. of higher mesh size).

Calculation of Mean particle size: Mean Particle Size is the geometric mean particle size on a mass basis calculated as the X intercept of the weighted regression line on the sigma versus log (size) plot.

The free moisture content (water that is not chemically bound) of the coloured particle of the invention is typically no greater than 5% by weight of the coloured particle, preferably no greater than 2% by weight or even no greater than 1.5 or 1% by weight of the particle.

The Colored Ingredient

The colored detergent ingredient of the present invention can be any detergent ingredient which has a substantially intense color as a raw material, such as enzymes, colored or dark clays. For the purpose of the present invention, the colored detergent ingredient is a hueing agent. The present invention enables the formulator to incorporate such hueing agents into detergent compositions in order to bring color to the fabric or wash solution.

A hueing agent is defined as a compound which upon washing provides white fabrics with a light off-white tint, modifying whiteness appearance and acceptance (e.g. bluish white, pinkish white). It can be colored material depositing on fabrics such as a pigment, a dye or a photo-bleach.

In a preferred embodiment of the present invention, the hueing agent is selected from pigments, dyes, photo-bleaches and mixtures thereof, more preferably the hueing agent is selected from dyes and pigments. The invention is particularly applicable to hueing agents comprising pigments, preferably Ultra Marine Blue.

The hueing agent may be incorporated into the coloured particles of the invention in amount of at least 8 wt %, preferably in amounts of at least 10 wt % or from 12, or 15 or even from 20 wt % based on the total weight of the particle. Generally the coloured particles will contain up to 75 wt % or up to 60 wt % or up to 50 wt % hueing agent. Where the hueing agent is a dye, lower levels are also acceptable for example from 0.5 to 10 wt % or even from 1 to 10 wt % or from 3 or 5 to 10 wt %.

Pigments

The colored detergent particle preferably comprises a pigment as a hueing agent. A pigment is a finely divided colouring material. Any pigment suitable for detergent compositions may be used herein. Pigments are insoluble colorants. Examples of pigments are Monastral Violet=Violet 19, Pigment Scarlet=Red 60, Blue cobaltous aluminate, and a most preferred example is Ultra Marine Blue pigment (e.g. CI 77007-Pigment Blue 29). Other examples are the coloured pigments disclosed in U.S. Pat. No. 4,671,886.

Dyes

Dyes are water soluble or water dispersible compounds that color the material onto which they have been anchored, by selectively absorbing certain wavelength of light. The principle feature of dyes is a conjugated system, allowing them to absorb energy in the visible part of the spectra.

Most common conjugated systems are phtalocyanine, anthraquinone, azo, phenyl groups, referred to as chromophore. Dyes can be chosen from the following categories: reactive dyes, direct dyes, sulphur and azoic dyes, acid dyes and disperse dyes. Direct dyes are water soluble molecules. Examples of direct dyes are Direct orange 18, direct blue 86, direct yellow 50=lemon yellow, direct red 80=basic red. Reactive dyes are for example dichloro triazine, dichloro quinoxaline, chlorodifluoropyrimidine. Disperse dyes are for example disperse red 13, violet 33=fuchsia, Blue C-4RA=National blue. Suitable dyes for use in the coloured particles of the invention comprise Polar Brilliant Blue GAW 180% sold by Ciba-Geigy SA, (similar to C.I. (Colour Index) 61135-Acid Blue 127), FD&C Blue No. 1 (CI 42090), Rhodamine BM (CI 45170), Pontacyl Light Yellow 36 (similar to CI 18820), Polar Brilliant Blue RAW (CI 61585-Acid Blue 80).

Photo-bleaches

Photo-bleaches are molecules, which absorb the energy from sunlight and transfer it by reacting with another molecule (typically oxygen) to produce a bleaching specie (singlet oxygen). Photo-bleaches are extensively conjugated rings, and therefore usually present a strong visible color. Typical compounds are phthalocyanines, based on zinc, copper, or aluminum. Examples include phthalocyanine blue (CI 74160) and phthalocyanine green (CI 74260).

The particles of the present invention comprise both a binder and either a suspending agent or suspending agent precursor. The binding agent is any conventional binder used in detergent compositions which dissolves or disintegrates on contact of the coloured detergent particle with the wash water in the presence of a detergent composition. Suitable binders may gel at very high concentrations in aqueous detergent solutions, but at low concentrations such as in the wash water will substantially completely dissolve or disperse to enable the contents of the particle to be released in the wash water. In this context, "low concentration" means at the concentrations typical of the amount of binder present when the coloured particles of the invention are incorporated into a detergent composition which is used in a wash process at its typical dosage levels. Binders are mixed with the other components of the particle in a liquid form, for example they are either liquid at the temperature of mixing or they are mixed with the other components to form the coloured particle in the form of an aqueous solution.

In addition, the coloured particles of the invention also comprise a suspending agent or pre-cursor thereof. In contrast to the binders, the suspending agents either already present in the particle or formed by reaction of the pre-cursor on contact of the particle with water, preferably remain in the form of a gel even at low concentrations in the wash water. Dispersed gel phases in the wash water are also acceptable.

Thus, for example a cellulose may be used to provide a binder and a cellulose may be used to provide a suspending agent, however, they will be different forms of cellulose e.g. they will have different molecular weights (lower for binding and higher for suspending) and/or different degrees of substitution, as the former will need to be provided in aqueous solution to be mixed with the other ingredients of the particle and then need to dissolve or disperse in the wash solution allowing the particle to dissolve, whereas the suspending agent needs to provide a surface area for suspending the hueing agent in the wash water and is either insoluble or in a gel phase in the wash water.

Binders

Any binder material can be used herein. Preferred binders are selected from synthetic organic polymers such as polyethylene glycols, polyvinylpyrrolidones, polyacetates, polymeric polycarboxylates such as water-soluble acrylate copolymers, cationic polymers such as ethoxylated hexamethylene diamine quaternary compounds, surfactants, liquid glucose, sugars and sugar alcohol such as sorbitol, manitol, Xylitol and mixtures thereof. Most preferred binders also have an active cleaning function in the wash such as the cationic polymers, surfactants or other examples include, bishexamethylene triamines or pentaamines, ethoxylated polyethylene amines, maleic/acrylic homo- or co-polymers.

Particularly preferred binders include the polymeric polycarboxylates such as acrylic acid homopolymers or copolymers with maleic acid or salts thereof, such as those sold by Rohm and Haas under the Sokolan trade name. A further class of preferred binders is surfactants. Surfactants may be anionic, nonionic, zwitterionic, cationic or mixtures thereof. Anionic surfactants are particularly preferred. Examples of suitable surfactants are given below in the definition of surfactants suitable for use in the detergent composition as a whole. Preferred anionic surfactants include alkyl sulphates and alkyl benzene sulphonates either alone or in admixture with one another or additional binders.

The binder is generally present in the coloured particle in amounts from 2 to 50% by weight of the coloured particle. More typically the binder will be present in amounts from 5 to 40% by weight or even from 10 to 25% by weight based on the weight of the particle.

Suspending Agent and Suspending Agent Pre-cursor

The suspending agent may comprise any water-swellable component which may be slowly water-soluble or insoluble in the alkaline wash liquor and which suspends the hueing agent as the coloured particles dissolve/disintegrate so that high localized concentrations of the hueing agent are dispersed prior to deposition of the hueing agent on the fabric surface. They may also assist in rapid disintegrating of the coloured particle. Examples of suitable materials include Acacia, Alginic Acid, Carbomer, Dextrin, Gelatin, Guar Gum, Hydrogenated vegetable oil type 1, Magnesium aluminum silicate, Maltodextrin, Methylcellulose, polymethacrylates, povidone, sodium alginate, starch and zein. Crosslinked polymers (water insoluble) such as crosslinked cellulose, crosslinked starch, crosslinked CMC, crosslinked carboxymethyl starch, crosslinked polyacrylates (Acusol771/772 from Rohm & Haas), and crosslinked polyvinyl pyrrolidones such as Sokolan HP62G from BASF), anionic exchange resins such as those based on polyacrylate or sulfonate (such as TD8 from Rohm & Haas) are also suitable. CMC cross-linked with aluminium II ions providing an insoluble disintegrant at pH 7 which dissolves when Al ions are released as the pH increases to around 10 in the wash water may also be used. Arbocel, Nymcel, Neutrogel and Polygel may be suitable. Swelling clays such as bentonite and laponite may be suitable suspending agents.

Water-swellable cellulosic materials are preferred. Particularly preferred are optionally substituted alkyl celluloses and salts thereof, such as ethylcellulose, hydroxyethyl cellulose, hydroxypropyl methyl cellulose, methyl cellulose and carboxymethyl cellulose. Sodium salt of carboxymethyl cellulose is particularly preferred. Preferred suspending agents are CMC salts, particularly those having a degree of substitution of from 0.3 to 0.9, more preferably from 0.45 to 0.6. Preferred suspending agents have a Brookfield viscosity (test method defined below) no greater than 1500 cps, more preferably, the viscosity of the suspending agent is from 25 to 1000, more preferably from 25 to 500 cps.

Brookfield Viscosity Measurement Method

A 1% by weight solution of the compound to be tested is prepared with deionised water in a 600 ml beaker by slowly adding the compound to be tested to the water at room temperature using a high speed, heavy-duty mixer to stir the solution (for example Stir-Pak Model 4554-20). Stir at about 2000-2300 rpm using a propeller style blade until the sample is substantially homogeneous. Then stir for a further 20 minutes. Place the sample beaker in an ultra-sonic bath for 15 minutes to remove the air bubbles after stirring. The sample is then equilibrated to 25° C. for at least one hour in a water bath. Using a Brookfield viscometer LVT series, selecting a #3 spindle and at 30 rpm, the spindle is immersed up to the middle of the indentation in the spindlle shaft. The spindle is allowed to rotate for 3 minutes before recording the reading. 3 successive readings are taken and the average determined.

In one embodiment of the invention, a suspending agent pre-cursor is present in the detergent composition. Such a suspending agent pre-cursor will react with one or more other components in the coloured particle on contact of the particle with the wash water, thus forming suspending agent for the hueing agent. One preferred suspending agent pre-cursor comprises multivalent metal ions. Suitable metal ions include any multivalent metal ions, for example Group II or Group III (of the Periodic Table) metal ions. Such metal ions may be provided in the coloured particle by incorporating any water soluble salt of the metal ion. Particularly preferred metal ions are calcium, magnesium and aluminium ions, with calcium ions being most preferred. When the suspending agent is provided in situ, in the wash water, the suspending agent pre-cursor must be present in the coloured particle in addition to a reactant for the pre-cursor which forms the suspending agent with the pre-cursor i.e. the pre-cursor must react with some other component of the coloured particle to produce the suspending agent, usually a gel, required for suspending the hueing agent. The reactant preferably has additional functionality in the particle, for example, preferably the reactant for the precursor is also a binder.

In the case of multivalent metal ions, preferably the coloured particle also comprises a surfactant most preferably an anionic surfactant for reacting with the multivalent metal ion. Particularly preferred anionic surfactants comprise alkylbenzene sulphonates and alkyl sulphates or mixtures thereof.

The suspending agent is typically present in the coloured particle in amounts from 3 to 80 wt %, generally in amounts from 5 to 70 wt %, or from 10 to 45 wt % based on the weight of the coloured particle. Suspending agent pre-cursor may be present in lower amounts such as from 0.5 to 10 wt % of the coloured particle, more usually from 0.5 to 5 wt % or even 1 to 3% by weight.

Multivalent Metal Ions

Multivalent metal ions are particularly useful as a component in the coloured particles of the invention where the hueing agent is a negatively charged pigment. The inventors have found that a coloured particle comprising a hueing agent, binder and multivalentmetal ion (having a charge of 2+ or greater) where the hueing agent is negatively charged is extremely effective as it results in more efficient use of the pigment in the coloured particle by precipitating out the pigment, thereby enhancing deposition. Without wishing to be bound by theory, it is believed that this is because the hueing agent and metal ion form an insoluble precipitate which deposits efficaciously on a fabric surface so that most efficient use of the hueing agent is achieved. In the embodiment of the invention described above in which the suspending agent is provided in situ by combination of multivalent metal ion and surfactant binder, these two effects can be combined. However, where the coloured particles comprise a suspending agent, preferably a multivalent metal ion is also present to enhance deposition. Preferred negatively charged pigment for use in this embodiment of the invention is UltraMarine Blue.

Other Ingredients

The colored particle may comprise other additional ingredients such as any material suitable for use in a detergent product, preferably a granular material. The material may be a complete detergent composition in itself, a usual ingredient in a detergent composition; and would include, but is not limited to builders, bleaches or bleach precursors, zeolites, buffers, chelants, hydratable salts and mixtures thereof, or could include any material not incompatible with the other ingredients or the purpose of a detergent product. Hydratable salts are most preferred as other ingredients, slowly hydrating hydratable salts being particularly preferred. Examples include salts with any conventional anion, preferably carbonates, phosphates, especially sodium tripolyphospahte, especially form II, aluminosilicates, chlorides, sulphates, acetates and citrate salts. Sodium salts of these hydratable salts may be preferred.

However in accordance with a further preferred embodiments of the invention the hydratable salt may be a multivalent metal ion salt so that the hydratable salt may also provide the suspending agent precursor and/or the multivalent metal ions for enhancing deposition of any negatively charged hueing agent. Preferred examples of multivalent metal ion hydratable salts include calcium sulphate (plaster of paris), magnesium sulphate, magnesium carbonate, calcium chloride. Such components will be present to balance, but are generally present in amounts from 5 to below 90 wt %, more typically from 10 to below 80 wt %, more typically from 15 to below 75 wt %. Typically, the colored particle will comprise the colored detergent ingredient, a carrier such as a hydratable salt, a binder and a suspending agent, optionally with a multivalent metal ion. The colored particle may further comprise an opaque pigment and/or a coating When multivalent metal ions are present in the coloured particles, and when the binder comprises anionic surfactant, in the making process, at the time of addition of the multivalent metal ions to the surfactant, preferably the total free water added in the processing and present in the ingredients mixed together to form the particle will be relatively low in order to minimize reaction between the surfactant and the multivalent metal ions. Preferably the total free water added and from raw materials will be below 10 wt %, preferably below 5 wt %, more preferably below 1 or even below 0.5 or 0.2 wt % based on the total weight of the particle. The acceptable levels of total free water added in the making process and via the raw materials will be dependent on the other ingredients in the particle as the total free moisture in the finished particle will be reduced by using hydratable salt. Preferably hydratable salt should be present in an amount that will substantially react with all of the free moisture in the particle. The free moisture in the coloured particles is preferably below 5 wt %, most preferably below 1 wt %, and more preferably below 0.5 or 0.2 wt %.

Method for Making the Particles

The colored particle may be prepared by any process wherein the colored ingredients, binder, suspending agent or precursor thereof and optionally further ingredients, are combined to form a mixture. The mixture may be in any form, such as a liquid, slurry, or a solid material, such as a granule, particulate or noodle. For example a particle comprising binder (liquid or in aqueous solution or suspension) and suspending agent may be prepared and then hueing agent is sprayed on. Alternatively, the hueing agent may be mixed with any crystalline components of the coloured particle and/or suspending agent, preferably in the presence of a binder. For example, the colored particle herein may be colored with a hueing agent, preferably a pigment and/dye and/or or a brightener by spraying the colorant onto solid componen0t of the coloured particle in a fluid bed dryer/coater or into a mixing-container or mix drum, containing the colored particles and optionally drying the colored speckle particles, preferably in a fluidized-bed.

The mixture may be formed into particulate materials, such as granules by for example an extrusion process, a fluid bed process, rotary atomization, agglomeration or a moulding process.

Preferably, the granules are formed by an agglomeration and/or extrusion process. The agglomeration and also the extrusion processes, provide a simple, fast, efficient, cost-effective means of preparing a granule, noodle, needle or shaped form of particles.

For the preparation of the mixture, any type of mixer may be used, especially a dynamic mixer. The mixing equipment will need to be selected to handle the relatively high viscosities that the mixture will reach. The exact viscosity will depend on the composition of the mixture and on the processing temperature. Preferably the processing temperature is below 120° C., preferably below 100° C., more preferably below 80° C., and most preferably between 15° C. and 75° C.

Preferred means are described in more detail below:

Fine Mixing and Granulation Including Agglomeration

Suitable pieces of equipment in which to carry out the fine mixing or granulation of the present invention are mixers of Fukae mixers such as the Fukae® FS-G Series manufactured by Fukae Powtech Kogyo Co. Japan. This apparatus is essentially in the form of a bowl-shaped vessel accessible via a top port, provided near its base with a stirrer having substantially vertical axis, and a cutter positioned on a side wall. The stirrer and cutter may be operated independently of one another and at separately variable speeds. The vessel can be fitted with a heating or cooling jacket. Other similar mixers found to be suitable for use in the process of the invention include Diosna® V series ex Dierks & Söhne, Germany; and the Pharma Matrix® ex T K Fielder Ltd., England. Other mixers believed to be suitable for use in the process of the invention are the Fuji® VG-C series ex Fuji Sangyo Co., Japan; and the Roto® ex Zanchetta & Co srl, Italy. Patterson-Kelly V-Blender, ribbon mixers, Sigma, Z-blade, Forberg mixers may also be suitable. High shear mixers for example as outlined below may be preferred although medium or low shear mixing may be equally suitable, they may require a greater recycle of fines or oversize particles, increasing processing expense.

Other preferred suitable equipment can include Eirich® Series R and RV, manufactured by Gustau Eirich Hardheim, Germany; Lödige, Series FM for batch mixing or series CB and KM, either separately or in series for continues mixing/agglomeration, manufactured by Lödige Maschinenbau GmbH, Paderborn Germany; Drais® T 160 Series, manufactured by Drais Werke GmbH,Mannheim, Germany; and Winkworth® RT 25 series, manufactured by Winkworth Manchinery Ltd., Berkshire, England. The Littleford Mixer, Model #FM-130-D-12, with internal chopping blades and the Cuisinart Food Processor, Model #DCX-Plus, with 7.75 inch (19.7 cm) blades are two more examples of suitable mixers. Any other mixer with fine mixing and granulation capability and having a residence time in the order of 0.1 to 10 minutes can be used. The "turbine-type" impeller mixer, having several blades on an axis of rotation, is preferred. The invention can be practiced as a batch or a continuous process. For any coating steps, a fluid bed coater or Wurster coater manufactured by Glatt GMBH in Germany may be suitable.

Preferably, the particle is made by agglomeration for example by any known agglomeration technique. Agglomerated coloured particles are preferably made in a high shear mixer such as a V-blender or double V blender, Fukae mixer, KM mixer, or CB mixer. The term "high shear mixing" is well understood by the person skilled in the art. Alternatively, the coloured particles may be prepared by extrusion optionally with a marumerisation or spheronisation step. This process route may be particularly preferred when the binder comprises surfactant as a surfactant paste may be prepared having activity for example greater than 40% by weight or even greater than 50 or 60 or even 80% by weight, the other ingredients are then mixed into the surfactant paste and the mixture extruded to form noodles.

Further Processing Steps

The colored particles obtained by the processes above are suitable for direct use, or may be treated by additional process steps such as the commonly used steps drying and or cooling, and/or dusting. The colored-particles of the present invention are typically blended with other detergent component to form a fully formulated detergent composition. The detergent components can be screened through different sieves to obtain coloured paticles of the preferred particle size.

The density of the detergent component of the present invention will generally be above 300 kg/m$^3$, preferably greater than 400 kg/m$^3$ or even greater than 500 kg/m$^3$. The density of the detergent granule according to the invention will generally be below 1500 kg/m$^3$, preferably below 1200 kg/m$^3$.

The colored particles of this particle size may preferably be obtained by binding smaller particles with a binder, for example by agglomeration, as described herein. They may also be obtained from larger particle size material, for example by grinding this material. Also, the colored particle of this particle size may alternatively or additionally be obtained by sieving the particles and selecting the required particle size material. Other methods for controlling the particle size of such material are known to the skilled person and may also be used to obtain the particles of the required size.

The present invention also comprises detergent compositions comprising the coloured particles defined above. Generally the concentration of the hueing agent in the coloured particle and the concentration of the coloured particle in the detergent composition will result in the overall concentration of the hueing agent in the detergent composition being from 0.01 to 5, preferably from 0.01 to 0.75 wt % based on total weight of detergent composition.

Compositions

The colored particle is preferably present in detergent compositions, preferably granular detergent compositions, which may subsequently be formed into tablets or other unit dose forms of detergent at a level of from 0.05% to 10% by weight of the composition, preferably from 0.5% to 7.5%, more preferably from 0.7% to 5% by weight of the detergent composition.

The detergent composition of the present invention is generally formulated for use in laundry cleaning processes. They are preferably in the form of granules, extrudates, flakes, cakes, detergent bars or tablets. They may additionally comprise any conventional ingredient commonly employed in detergent compositions.

The detergent compositions can comprise a wide variety of different ingredients, such as building agents, effervescent system, enzymes, dissolution aids, disintegrants, bleaching agents, suds supressors, surfactants (nonionic, anionic, cationic, amphoteric, and/or zwitterionic), fabric softening agents, alkalinity sources, colorants, perfumes, lime soap dispersants, organic polymeric compounds including polymeric dye transfer inhibiting agents, crystal growth inhibitors, anti-redeposition agents, soil release polymers, hydrotropes, fluorescents, heavy metal ion sequestrants, metal ion salts, enzyme stabilisers, corrosion inhibitors, optical brighteners, and combinations thereof. The compositions herein can also be used as detergent additive products. Such additive products are intended to supplement or boost the performance of conventional detergent compositions and can be added at any stage of the cleaning process.

Granular Composition

As described above, detergent compositions comprising the particles of the invention will comprise at least some of the usual detergent adjunct materials, such as agglomerates, extrudates, other spray dried particles having different composition to those of the invention, or dry added materials. Conventionally, surfactants are incorporated into agglomerates, extrudates or spray dried particles along with solid materials, usually builders, and these may be admixed with the spray dried particles of the invention. However, as described above some or all of the solid material may be replaced with the particles of the invention.

The detergent adjunct materials are typically selected from the group consisting of detersive surfactants, builders, polymeric co-builders, bleach, chelants, enzymes, anti-redeposition polymers, soil-release polymers, polymeric soil-dispersing and/or soil-suspending agents, dye-transfer inhibitors, fabric-integrity agents, suds suppressors, fabric-softeners, flocculants, perfumes, whitening agents, photobleach and combinations thereof.

The precise nature of these additional components, and levels of incorporation thereof will depend on the physical form of the composition or component, and the precise nature of the washing operation for which it is to be used.

A highly preferred adjunct component is a surfactant. Preferably, the detergent composition comprises one or more surfactants. Typically, the detergent composition comprises (by weight of the composition) from 0% to 50%, preferably from 5% and more preferably from 10 or even 15 wt % to 40%, or to 30%, or to 20% one or more surfactants. Preferred surfactants are anionic surfactants, non-ionic surfactants, cationic surfactants, zwitterionic surfactants, amphoteric surfactants, cationic surfactants and mixtures thereof.

Preferred anionic surfactants comprise one or more moieties selected from the group consisting of carbonate, phosphate, sulphate, sulphonate and mixtures thereof. Preferred anionic surfactants are $C_{8-18}$ alkyl sulphates and $C_{8-18}$ alkyl sulphonates. Suitable anionic surfactants incorporated alone or in mixtures in the compositions of the invention are also the $C_{8-18}$ alkyl sulphates and/or $C_{8-18}$ alkyl sulphonates optionally condensed with from 1 to 9 moles of $C_{1-4}$ alkylene oxide per mole of $C_{8-18}$ alkyl sulphate and/or $C_{8-18}$ alkyl sulphonate. The alkyl chain of the $C_{8-18}$ alkyl sulphates and/or $C_{8-18}$ alkyl sulphonates may be linear or branched, preferred branched alkyl chains comprise one or more branched moieties that are $C_{1-6}$ alkyl groups. Other preferred anionic surfactants are $C_{8-18}$ alkyl benzene sulphates and/or $C_{8-18}$ alkyl benzene sulphonates. The alkyl chain of the $C_{8-18}$ alkyl benzene sulphates and/or $C_{8-18}$ alkyl benzene sulphonates may be linear or branched, preferred branched alkyl chains comprise one or more branched moieties that are $C_{1-6}$ alkyl groups.

Other preferred anionic surfactants are selected from the group consisting of: $C_{8-18}$ alkenyl sulphates, $C_{8-18}$ alkenyl sulphonates, $C_{8-18}$ alkenyl benzene sulphates, $C_{8-18}$ alkenyl benzene sulphonates, $C_{8-18}$ alkyl di-methyl benzene sulphate, $C_{8-18}$ alkyl di-methyl benzene sulphonate, fatty acid ester sulphonates, di-alkyl sulphosuccinates, and combinations thereof. The anionic surfactants may be present in the salt form. For example, the anionic surfactant may be an alkali metal salt of one or more of the compounds selected from the group consisting of: $C_{8-18}$ alkyl sulphate, $C_{8-18}$ alkyl sulphonate, $C_{8-18}$ alkyl benzene sulphate, $C_8$-$C_{18}$ alkyl benzene sulphonate, and combinations thereof. Preferred alkali metals are sodium, potassium and mixtures thereof. Typically, the detergent composition comprises from 10% to 30wt % anionic surfactant.

Preferred non-ionic surfactants are selected from the group consisting of: $C_{8-18}$ alcohols condensed with from 1 to 9 of $C_1$-$C_4$ alkylene oxide per mole of $C_{8-18}$ alcohol, $C_{8-18}$ alkyl N-$C_{1-4}$ alkyl glucamides, $C_{8-18}$ amido $C_{1-4}$ dimethyl amines, $C_{8-18}$ alkyl polyglycosides, glycerol monoethers, polyhydroxyamides, and combinations thereof. Typically the detergent compositions of the invention comprises from 0 to 15, preferably from 2 to 10 wt % non-ionic surfactant.

Preferred cationic surfactants are quaternary ammonium compounds. Preferred quaternary ammonium compounds comprise a mixture of long and short hydrocarbon chains, typically alkyl and/or hydroxyalkyl and/or alkoxylated alkyl chains. Typically, long hydrocarbon chains are $C_{8-18}$ alkyl chains and/or $C_{8-18}$ hydroxyalkyl chains and/or $C_{8-18}$ alkoxylated alkyl chains. Typically, short hydrocarbon chains are $C_{1-4}$ alky chains and/or $C_{1-4}$ hydroxyalkyl chains and/or $C_{1-4}$ alkoxylated alkyl chains. Typically, the detergent composition comprises (by weight of the composition) from 0% to 20% cationic surfactant.

Preferred zwitterionic surfactants comprise one or more quaternized nitrogen atoms and one or more moieties selected from the group consisting of: carbonate, phosphate, sulphate, sulphonate, and combinations thereof. Preferred zwitterionic surfactants are alkyl betaines. Other preferred zwitterionic surfactants are alkyl amine oxides. Catanionic surfactants which are complexes comprising a cationic surfactant and an anionic surfactant may also be included. Typically, the molar ratio of the cationic surfactant to anionic surfactant in the complex is greater than 1:1, so that the complex has a net positive charge.

A further preferred adjunct component is a builder. Preferably, the detergent composition comprises (by weight of the composition and on an anhydrous basis) from 5% to 50% builder. Preferred builders are selected from the group consisting of: inorganic phosphates and salts thereof, preferably orthophosphate, pyrophosphate, tri-poly-phosphate, alkali metal salts thereof, and combinations thereof; polycarboxylic acids and salts thereof, preferably citric acid, alkali metal salts of thereof, and combinations thereof; aluminosilicates, salts thereof, and combinations thereof, preferably amorphous aluminosilicates, crystalline aluminosilicates, mixed amorphous/crystalline aluminosilicates, alkali metal salts thereof, and combinations thereof, most preferably zeolite A, zeolite P, zeolite MAP, salts thereof, and combinations thereof; silicates such as layered silicates, salts thereof, and combinations thereof, preferably sodium layered silicate; and combinations thereof.

A preferred adjunct component is a bleaching agent. Preferably, the detergent composition comprises one or more bleaching agents. Typically, the composition comprises (by weight of the composition) from 1% to 50% of one or more bleaching agent. Preferred bleaching agents are selected from the group consisting of sources of peroxide, sources of peracid, bleach boosters, bleach catalysts, photo-bleaches, and combinations thereof. Preferred sources of peroxide are selected from the group consisting of: perborate monohydrate, perborate tetrahydrate, percarbonate, salts thereof, and combinations thereof. Preferred sources of peracid are selected from the group consisting of: bleach activator typically with a peroxide source such as perborate or percarbonate, preformed peracids, and combinations thereof. Preferred bleach activators are selected from the group consisting of: oxy-benzene-sulphonate bleach activators, lactam bleach activators, imide bleach activators, and combinations thereof. A preferred source of peracid is tetra-acetyl ethylene diamine (TAED)and peroxide source such as percarbonate. Preferred oxy-benzene-sulphonate bleach activators are selected from the group consisting of: nonanoyl-oxy-benzene-sulponate, 6-nonamido-caproyl-oxy-benzene-sulphonate, salts thereof, and combinations thereof. Preferred lactam bleach activators are acyl-caprolactams and/or acyl-valerolactams. A preferred imide bleach activator is N-nonanoyl-N-methyl-acetamide.

Preferred preformed peracids are selected from the group consisting of N,N-pthaloyl-amino-peroxycaproic acid, nonyl-amido-peroxyadipic acid, salts thereof, and combinations thereof. Preferably, the STW-composition comprises one or more sources of peroxide and one or more sources of peracid. Preferred bleach catalysts comprise one or more transition metal ions. Other preferred bleaching agents are di-acyl peroxides. Preferred bleach boosters are selected from the group consisting of: zwitterionic imines, anionic imine polyions, quaternary oxaziridinium salts, and combinations thereof. Highly preferred bleach boosters are selected from the group consisting of: aryliminium zwitterions, aryliminium polyions, and combinations thereof. Suitable bleach boosters are described in U.S. Pat. No. 5,360,568, U.S. Pat. No. 5,360,569 and U.S. Pat. No. 5,370,826.

A preferred adjunct component is an anti-redeposition agent. Preferably, the detergent composition comprises one or more anti-redeposition agents. Preferred anti-redeposition agents are cellulosic polymeric components, most preferably carboxymethyl celluloses.

A preferred adjunct component is a chelant. Preferably, the detergent composition comprises one or more chelants. Preferably, the detergent composition comprises (by weight of the composition) from 0.01% to 10% chelant. Preferred chelants are selected from the group consisting of: hydroxyethane-dimethylene-phosphonic acid, ethylene diamine tetra(methylene phosphonic) acid, diethylene triamine pentacetate, ethylene diamine tetraacetate, diethylene triamine penta(methyl phosphonic) acid, ethylene diamine disuccinic acid, and combinations thereof.

A preferred adjunct component is a dye transfer inhibitor. Preferably, the detergent composition comprises one or more dye transfer inhibitors. Typically, dye transfer inhibitors are polymeric components that trap dye molecules and retain the dye molecules by suspending them in the wash liquor. Preferred dye transfer inhibitors are selected from the group consisting of: polyvinylpyrrolidones, polyvinylpyridine N-oxides, polyvinylpyrrolidone-polyvinylimidazole copolymers, and combinations thereof.

A preferred adjunct component is an enzyme. Preferably, the detergent composition comprises one or more enzymes. Preferred enzymes are selected from then group consisting of: amylases, arabinosidases, carbohydrases, cellulases, chondroitinases, cutinases, dextranases, esterases, β-glucanases, gluco-amylases, hyaluronidases, keratanases, laccases, ligninases, lipases, lipoxygenases, malanases, mannanases, oxidases, pectinases, pentosanases, peroxidases, phenoloxidases, phospholipases, proteases, pullulanases, reductases, tannases, transferases, xylanases, xyloglucanases, and combinations thereof. Preferred enzymes are selected from the group consisting of: amylases, carbohydrases, cellulases, lipases, proteases, and combinations thereof.

A preferred adjunct component is a fabric integrity agent. Preferably, the detergent composition comprises one or more fabric integrity agents. Typically, fabric integrity agents are polymeric components that deposit on the fabric surface and prevent fabric damage during the laundering process. Preferred fabric integrity agents are hydrophobically modified celluloses. These hydrophobically modified celluloses reduce fabric abrasion, enhance fibre-fibre interactions and reduce dye loss from the fabric. A preferred hydrophobically modified cellulose is described in WO99/14245. Other preferred fabric integrity agents are polymeric components and/or oligomeric components that are obtainable, preferably obtained, by a process comprising the step of condensing imidazole and epichlorhydrin.

A preferred adjunct component is a salt. Preferably, the detergent composition comprises one or more salts. The salts can act as alkalinity agents, buffers, builders, co-builders, encrustation inhibitors, fillers, pH regulators, stability agents, and combinations thereof. Typically, the detergent composition comprises (by weight of the composition) from 5% to 60% salt. Preferred salts are alkali metal salts of aluminate, carbonate, chloride, bicarbonate, nitrate, phosphate, silicate, sulphate, and combinations thereof. Other preferred salts are alkaline earth metal salts of aluminate, carbonate, chloride, bicarbonate, nitrate, phosphate, silicate, sulphate, and combinations thereof. Especially preferred salts are sodium sulphate, sodium carbonate, sodium bicarbonate, sodium silicate, sodium sulphate, and combinations thereof. Optionally, the alkali metal salts and/or alkaline earth metal salts may be anhydrous.

A preferred adjunct component is a soil release agent. Preferably, the detergent composition comprises one or more soil release agents. Typically, soil release agents are polymeric compounds that modify the fabric surface and prevent the redeposition of soil on the fabric. Preferred soil release agents are copolymers, preferably block copolymers, comprising one or more terephthalate unit. Preferred soil release agents are copolymers that are synthesised from dimethylterephthalate, 1,2-propyl glycol and methyl capped polyethyleneglycol. Other preferred soil release agents are anionically end capped polyesters.

A preferred adjunct component is a soil suspension agent. Preferably, the detergent composition comprises one or more soil suspension agents. Preferred soil suspension agents are polymeric polycarboxylates. Especially preferred are polymers derived from acrylic acid, polymers derived from maleic acid, and co-polymers derived from maleic acid and acrylic acid. In addition to their soil suspension properties, polymeric polycarboxylates are also useful co-builders for laundry detergents. Other preferred soil suspension agents are alkoxylated polyalkylene imines. Especially preferred alkoxylated polyalkylene imines are ethoxylated polyethylene imines, or ethoxylated-propoxylated polyethylene imine. Other preferred soil suspension agents are represented by the formula:

$$\text{bis}((C_2H_5O)(C_2H_4O)_n(CH_3)\text{—}N^+\text{—}C_xH_{2x}\text{—}N^+\text{—}(CH_3)\text{-bis}((C_2H_4O)_n(C_2H_5O)),$$

wherein, n=from 10 to 50 and x=from 1 to 20. Optionally, the soil suspension agents represented by the above formula can be sulphated and/or sulphonated.

Softening System

The detergent compositions of the invention may comprise softening agents for softening through the wash such as clay optionally also with flocculant and enzymes.

EXAMPLES

All Percentages, parts and ratio's are by weight unless otherwise indicated.

Example 1

2 kg of Light Carbonate, 1.2 kg Ultra Marine Blue powder and 1.05 kg Carboxymethyl Cellulose powder (70% active) was added to the 8 qt V-Blender and the powdered material pre-mixed for 30 sec at shell RPM of 24 and Intensifier Bar RPM of 1200. Add the pre-mixed Binder solution of 0.6 kg water and 1.14 kg Sodium Polyacrylate solution (45% active), through the intensifier bar in 7 mins. Add 0.31 kg of light carbonate to the wet agglomerate and post mix for 2 minutes with both Shell and Intensifier running at original operating condition. Post mixing stop intensifier bar and keep mixing by running the shell to gently mix the agglomerate for 5 minutes, the free moisture gets hydrated giving us free flowing dark blue agglomerate. The agglomerate should be passed through a 10 tyler sieve. The particle size distribution of the finished UMB agglomerate is in the range of 200 to 1400 microns.

Example 2

2 kg of Light Carbonate, 1.2 kg Ultra Marine Blue powder and 1.05 kg Carboxymethyl Cellulose powder (70% active) was added to the 8qt V-Blender and the powdered material pre-mixed for 30 sec at shell RPM of 24 and Intensifier Bar RPM of 1200. Add the pre-mixed Binder solution of 0.59 kg water, 0.011 kg Zinc Phthalocyanide Sulphonate solution (20% active) and 1.14 kg Sodium Polyacrylate solution (45% active), through the intensifier bar in 7 mins. Add 0.31 kg of light carbonate to the wet agglomerate and post mix for 2 minutes with both Shell and Intensifier running at original operating condition. Post mixing stop intensifier bar and keep mixing by running the shell to gently mix the agglomerate for 5 minutes, the free moisture gets hydrated giving us free flowing dark blue agglomerate. The agglomerate should be passed through a 10 tyler sieve. The particle size distribution of the finished UMB agglomerate is in the range of 200 to 1400 microns.

Example 3

TABLE 1

| Ingredient | Raw Material Activity | Level in finished noodle |
|---|---|---|
| Ultramarine blue | 100% | 2.7% |
| Sodium alkylbenzene sulphonate (NaLAS) | 45% | 8.2% |
| CMC | 55% | 4.2% |
| Sodium Carbonate | 100% | 79.8% |
| Calcium sulphate | 100% | 3.2% |
| water | | 2.0% |

Carbonate (fine Carbonate, preferably classified Carbonate), CMC, Ultramarine blue pigment, calcium sulphate are mixed first in a high shear mixer in the relative amounts given above. NaLAS paste and H2O are then added and mixed. The starting moisture is about 15%-20% by weight. The mixture is then extruded by dosing continuously to the extruder. The wet noodles are produced. The wet noodles are then added to a fluid bed dryer and dried, the finished moisture level is about 2-3%, no higher than 10% by weight of the coloured particle. The noodles are then passed through one Marumerizer to modify the shape of the noodles.

Example 4

TABLE 2

| Ingredient | Raw Material Activity | Level in finished noodle |
|---|---|---|
| Ultramarine blue | 100% | 13.3% |
| CMC | 55% | 0.6% |
| CaSO4 | 100% | 7.8% |
| Sodium carbonate + sodium sulfate | 100% | 76.3% (31.0% sodium sodium carbonate + 45.3% sodium sulfate) |
| H2O | | 2% |

Carbonate, sulfate, CMC, UMB, CaSO4 and water are mixed in a high shear mixer. The starting moisture is about 10%-15%. Granulation is then effected in any wet granulator, eg, CB and/or KM mixer, basket extruder. Eg, for a basket extruder, the wet mix are pressed through a certain size screen (0.85 mm) to produce wet granules. The wet granules are then added to a rotary dryer. After drying, the finished granule moisture level is within 4%, no higher than 10% by weight. The granules are then screened to remove oversize (eg, >1.25 mm) and fines (eg, <0.6 mm) and oversize and fines are recycled.

Example 5

The detergent composition comprising the coloured agglomerates from any of Examples 1 to 4 make up the finished granular detergents or could be compressed to form Tablets.

| Ingredients | A | B | C | D | E | F | G |
|---|---|---|---|---|---|---|---|
| Sodium linear $C_{11-13}$ alkylbenzene sulfonate | 11% | 12% | 10% | 18% | 15% | 16% | 20% |
| $R_2N^+(CH_3)_2(C_2H_4OH)$, wherein $R_2$ = $C_{12-14}$ alkyl group | 0.6% | 1% | | | 0.6% | | 1.2% |
| Sodium $C_{12-18}$ linear alkyl sulfate condensed with an average of 3 to 5 moles of ethylene oxide per mole of alkyl sulfate | | 0.3% | 2% | 2% | | | |
| Mid chain methyl branched sodium $C_{12}$-$C_{14}$ linear alkyl sulfate | 1.4% | 1.2% | 1% | | | | |
| Sodium $C_{12-18}$ linear alkyl sulfate | 0.7% | 0.5% | | | | | |
| $C_{12-18}$ linear alkyl ethoxylate condensed with an average of 3-9 moles of ethylene oxide per mole of alkyl alcohol | | 3% | 2% | | | | 1% |
| Citric acid | 2% | 1.5% | | | 2% | | |
| Sodium tripolyphosphate (anhydrous weight given) | | | 20% | 25% | 22% | 7.5% | 25% |
| Sodium carboxymethyl cellulose | 0.2% | 0.2% | | 0.3% | | 0.7% | 0.3% |
| Sodium polyacrylate polymer having a weight average molecular weight of from 3000 to 5000 | | 0.5% | 1% | | 0.7% | | 0.6% |
| Copolymer of maleic/acrylic acid, having a weight average molecular weight of from 50,000 to 90,000, wherein the ratio of maleic to acrylic acid is from 1:3 to 1:4 (Sokalan CP5 from BASF) | 2.1% | 2.3% | 2.1% | 1.4% | 1.4% | | |
| EDDS (ethylenediamine-N,N'-disuccinic acid (S,S isomer) in the form of its sodium salt) | 0.3% | 0.5% | 0.6% | 0.4% | 0.4% | | |
| Diethylene triamine pentaacetic acid | 0.2% | | 0.5% | 0.2% | 0.3% | | 0.3% |
| HEDP (1,1-hydroxyethane diphosphonic acid) | 0.5% | 1.0% | 1.0% | 0.7% | 0.7% | | |
| Proteolytic enzyme having an enzyme activity of from 15 mg/g to 70 mg/g | 0.2% | 0.2% | 0.5% | 0.4% | 0.3% | 0.2% | 0.5% |
| Amyolitic enzyme having an enzyme activity of from 25 mg/g to 50 mg/g | 0.2% | 0.2% | 0.3% | 0.4% | 0.3% | 0.1% | 0.2% |
| Lipolytic enzyme having an enzyme activity of 5 mg/g to 25 mg/g | | 0.2% | 0.1% | | | 0.1% | 0.1% |
| Anhydrous sodium perborate monohydrate | | | 20% | 5% | 8% | | |
| Sodium percarbonate | 10% | 12% | | | | | 1.5% |
| Magnesium sulfate | 0.1% | 0.2% | 0.2% | 0.1% | 0.1% | | |
| Nonanoyl oxybenzene sulfonate | | | | 2% | 1.2% | | 0.75% |
| Tetraacetylethylenediamine | 3% | 4% | 2% | 0.6% | 0.8% | | |
| Brightener | 0.1% | 0.1% | 0.2% | 0.1% | 0.1% | 0.1% | 0.2% |
| Sodium carbonate | 10% | 10% | 10% | 19% | 22% | 29% | 30% |
| Sodium sulfate | 20% | 15% | 5% | 13% | 1% | 37% | 6% |
| Zeolite A | 23% | 22% | 8% | 6% | 18% | 8% | 8% |
| Sodium silicate (2.0 R) | | 0.2% | | 1% | 1% | | 1.5% |
| Crystalline layered silicate | 3% | 5% | 10% | | | | |
| Photobleach | 0.002% | | | | | 0.002% | 0.003% |
| Polyethylene oxide having a weight average molecular weight from 100 to 10,000 | 2% | 1% | | | | | |
| Perfume spray-on | 0.2% | 0.5% | 0.25% | 0.1% | | 0.2% | 0.5% |
| Starch encapsulated perfume | 0.4% | 0.1% | 2% | 3% | 0.5% | | |
| Silicone based suds suppressor | 0.05% | 0.05% | | | 0.02% | | |
| Coloured agglomerate from Sample 1 & 2 | 0.75 | 0.75 | 0.75 | | 0.75 | 0.75% | 2.5% |
| Miscellaneous and moisture | To 100% | To 100% | To 100% | To 100% | To 100% | To 100% | To 100% |

All documents cited in the Detailed Description of the Invention are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

The invention claimed is:

1. A granular detergent composition comprising:

a. from 0.01% to 10% by weight of the composition of, a coloured particle consisting of:

i. from 8 to 50 wt % a hueing agent which is a pigment, ii. from 2 to 40 wt % a binder selected from the group consisting of an anionic surfactant and a polymeric polycarboxylate.

iii. from 0.5 to 5 wt % suspending agent precursor consisting of a multivalent metal ion, iv. from 3 to 80 wt % of a water-swellable suspending agent, v. a hydratable salt, and vi. less than 5 wt % of free moisture, wherein said pigment is negatively charged and wherein said multivalent metal ion has a charge of 2+ or greater; and b. a builder.

2. The granular detergent composition according to claim 1, wherein said negatively charged pigment is ultramarine blue.

3. The granular detergent composition according to claim 1, wherein the overall concentration of hueing agent is from 0.01% to 0.75% by weight of said detergent composition.

4. The granular detergent composition according to claim 1, wherein said anionic surfactant is selected from the group consisting of a $C_{8-18}$ alkyl sulphate and a $C_{8-18}$ alkyl sulphonate.

5. The granular detergent composition according to claim 1, wherein the anionic surfactants is selected from the group consisting of: a $C_{8-18}$ alkenyl sulphate, a $C_{8-18}$ alkenyl sulphonate, a $C_{8-18}$ alkenyl benzene sulphate, a $C_{8-18}$ alkenyl benzene sulphonate, a $C_{8-18}$ alkyl di-methyl benzene sulphate, a $C_{8-18}$ alkyl di-methyl benzene sulphonate, a fatty acid ester sulphonate, a di-alkyl sulphosuccinate, and a combination thereof.

6. The granular detergent composition according to claim 1 wherein the multivalent metal ion is selected from the group consisting of magnesium ions, calcium ions, aluminium ions and mixtures thereof.

7. The granular detergent composition according to claim 1 wherein the binder is a polymeric polycarboxylate.

8. The granular detergent composition according to claim 1 wherein the suspending agent is an optionally substituted alkyl cellulose.

9. The granular detergent composition according to claim 1 wherein the suspending agent is a carboxymethyl cellulose sodium salt.

10. The granular detergent composition according to claim 1 wherein the free moisture is below 0.2 wt %.

11. A method for making a granular detergent composition according to claim 1, said method comprising a step of forming a coloured particle comprising an extrusion step or an agglomeration step.

12. A method of imparting a hueing effect to fabrics, said method comprising contacting a fabric with a granular detergent composition according to claim 1.

13. A coloured particle consisting of:

i. from 8 to 50 wt % a hueing agent which is a pigment, ii. from 2 to 40 wt % an anionic surfactant or a polymeric polycarboxylate, iii. from 0.5 to 5 wt % a multivalent metal ion, iv. from 3 to 80 wt % of a water-swellable suspending agent, v. a hydratable salt, and vi. less than 5 wt % of free moisture, wherein said pigment is negatively charged and wherein said multivalent metal ion has a charge of 2+ or greater.

14. The coloured particle according to claim 13, wherein said negatively charged pigment is ultramarine blue.

* * * * *

UNITED STATES PATENT AND TRADEMARK OFFICE

CERTIFICATE OF CORRECTION

PATENT NO. : 7,645,729 B2
APPLICATION NO. : 11/185479
DATED : January 12, 2010
INVENTOR(S) : Cardozo et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 379 days.

Signed and Sealed this

Sixteenth Day of November, 2010

David J. Kappos

David J. Kappos
*Director of the United States Patent and Trademark Office*